United States Patent [19]

Farfor

[11] 4,028,036

[45] June 7, 1977

[54] ROTATABLE CONCRETE PROFILING MEANS

[75] Inventor: James Douglas Farfor, Brighton, Australia

[73] Assignee: Fictor Pty. Limited, Brighton, Australia

[22] Filed: June 3, 1975

[21] Appl. No.: 583,448

[30] Foreign Application Priority Data

June 3, 1974 Australia ..... 7747/74

[52] U.S. Cl. ..... 425/374; 425/115; 425/219; 425/328; 425/385; 425/436 R

[51] Int. Cl.[2] ..... B28B 3/12

[58] Field of Search ..... 425/218–219, 425/363, 374, 385, 403, 115, 328, 436; 404/124, 117, 119, 120

[56] References Cited

UNITED STATES PATENTS

| | | | |
|---|---|---|---|
| 1,153,348 | 9/1915 | Segee | 404/124 |
| 1,632,317 | 6/1927 | Schlegal | 425/374 |
| 3,775,529 | 11/1973 | Steenson et al. | 425/218 |
| 3,900,279 | 8/1975 | Newby | 425/385 |

FOREIGN PATENTS OR APPLICATIONS

| | | |
|---|---|---|
| 1,173,112 | 12/1969 | United Kingdom |
| 656,846 | 9/1951 | United Kingdom |
| 678,727 | 9/1952 | United Kingdom |

*Primary Examiner*—Ronald J. Shore
*Assistant Examiner*—John McQuade
*Attorney, Agent, or Firm*—Larson, Taylor and Hinds

[57] ABSTRACT

The surface of a mouldable material such as wet cement is shaped to a desired configuration by a profile forming device moved longitudinally relative to the material and rotated about an axis transverse to the direction of bodily movement. The profile forming device is eccentrically mounted or otherwise shaped to produce cyclic variation in level in the longitudinal direction and has a variable configuration along its length to provide a transverse variation in level of the surface. The profile forming device is driven at a speed to cause rubbing over the surface. It may also be moved bodily in a cyclic manner in the direction of its axis and/or away from and towards the surface.

5 Claims, 10 Drawing Figures

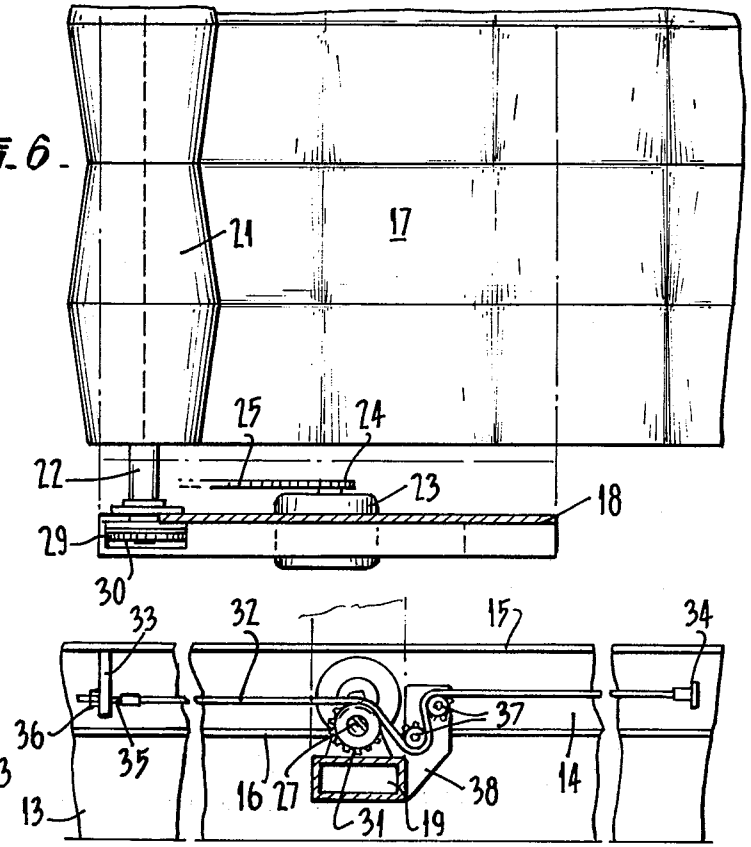
FIG. 6.
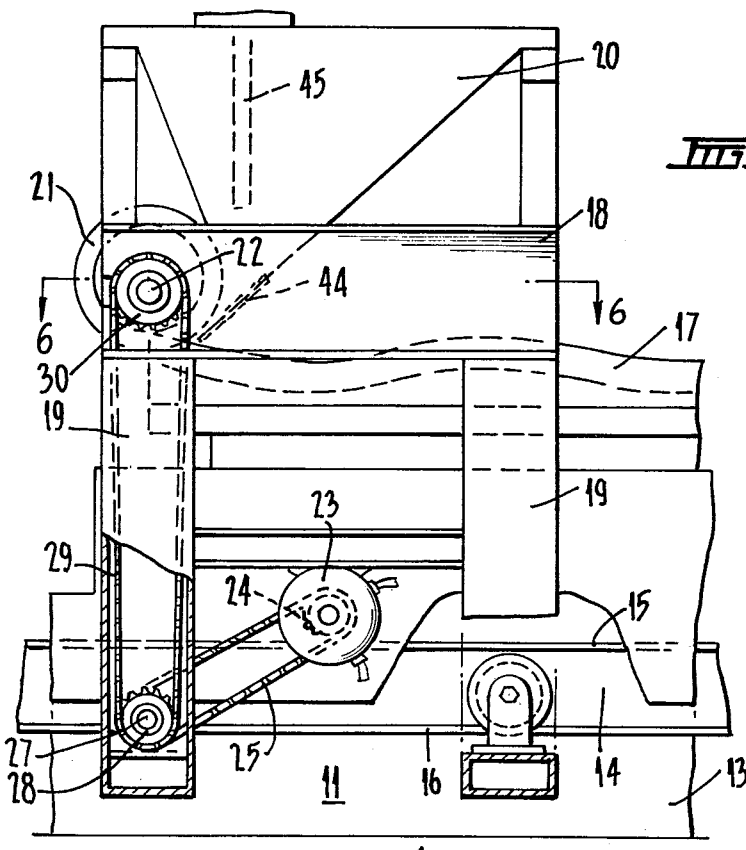
FIG. 5.
FIG. 4.

ROTATABLE CONCRETE PROFILING MEANS

This invention relates to improvements in and connected with the formation of shaped surfaces and is concerned more particularly with the distribution of mouldable or settable material with a surface which is shaped to a non-planar configuration, although it is not necessarily restricted thereto.

It is a known practice to deposit cementitious materials or other products on a base, by supplying the material to a hopper or the like from which the material is dispensed and to strike off the surface of the material with a profile forming device which may be attached to the hopper or may be separate from it.

One known form of profile forming device comprises a plate which may be vibrated and which strikes off excess material to produce the required surface configuration. It is also known to use a rotatable device which is arranged to roll over the material so as to displace excess material ahead of itself and to leave the required surface configuration behind it.

Surface forming devices of known types are disadvantageous in that their manner of operation tends to result in the material slumping or flowing from higher to lower regions after the device has passed with the result that the surface configuration is different from the desired shape.

One object of the present invention is to provide a profile forming device which will improve the accuracy of surface configurations produced with the device and which will reduce the disadvantage referred to above.

According to one aspect of the invention profile forming means is characterised by the provision of a rotatable device having means for providing a positive rotation of the device synchronised with travel of the device relative to the surface to be formed. Preferably the direction of rotation is counter to the normal direction of rolling upon the surface.

According to another aspect thereof the present invention contemplates the provision of a rotary profile forming device having a non-constant radius at at least some cross-sections. In stating that the member has a non-constant radius it is to be understood that the radius at at least some cross-sections of the device changes in an angular sense. Thus the cross-section may be non-circular, it may be circular but arranged eccentrically so that the centre of the circle is spaced from the centre of rotation, or it may be both non-circular and eccentric. By providing a profile forming member which is not a complete solid of revolution about its axis of rotation the result is achieved that at least some parts of the member vary cyclically in the extent of displacement at the contact surface as the member rotates and thereby a cyclic variation in the surface profile of the formed article, viewed in a longitudinal section, is obtained.

The rotary device may be formed, for example, from a solid or hollow cylinder mounted to rotate about an eccentric axis. Alternatively the member may comprise a solid or hollow article which is of uniform but non-circular cross-section, mounted about an axis which is eccentric or non-eccentric. Thus the article could be of rectilinear lobed cross-section. In each of these arrangements the article will produce a surface which has cyclic variations in the longitudinal direction but not in the transverse direction.

The invention further contemplates forming the rotary device so that its cross-section is not uniform but differs from place to place along the length of its axis or rotation. Thus its cross-section may be a circle or other geometrical figure which increases and decreases in size in a regular manner with the distance along the axis. Alternatively it may be a non-circular figure which alters its angular orientation about the axis with distance along the axis. Again it may be a figure such as an ellipse or rectangle which alters its proportions with distance along the axis. With such arrangements the article will produce a surface which has variations in both the longitudinal and transverse directions.

Still further aspects of the invention reside in mounting and driving the rotary device so that it moves bodily in a cyclic fashion. Thus cam mechanism or the like may be produced to cause the device to move cyclically in the direction of its axis, and other cam mechanism or other means may be employed to cause the device to rise bodily and descend bodily in conjunction with its rotational and translational motion.

Although it is not limited thereto the invention has particular application in the formation of panels by applying an upper mould, to the surface of material which has been spread on a lower mould and shaped by the rotatable device, removing liquid from the material through the moulds, and then separating the moulds to remove the panel. In the following description of a particular preferred form of the invention reference is made to the accompanying drawings in which:

FIG. 4 is a view in section on line 4—4 of FIG. 3,

FIG. 5 is a view in section on line 5—5 of FIG. 3,

FIG. 6 is a view in section on line 6—6 of FIG. 4,

Figure 1:
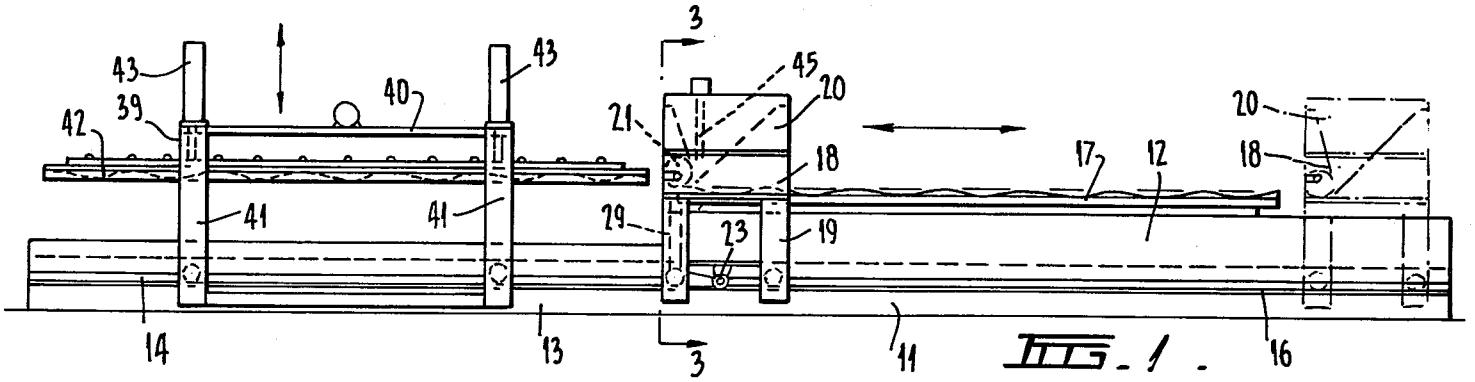
FIG. 1 is a schematic view in side elevation of apparatus according to this particular form of the invention.
Figure 2:
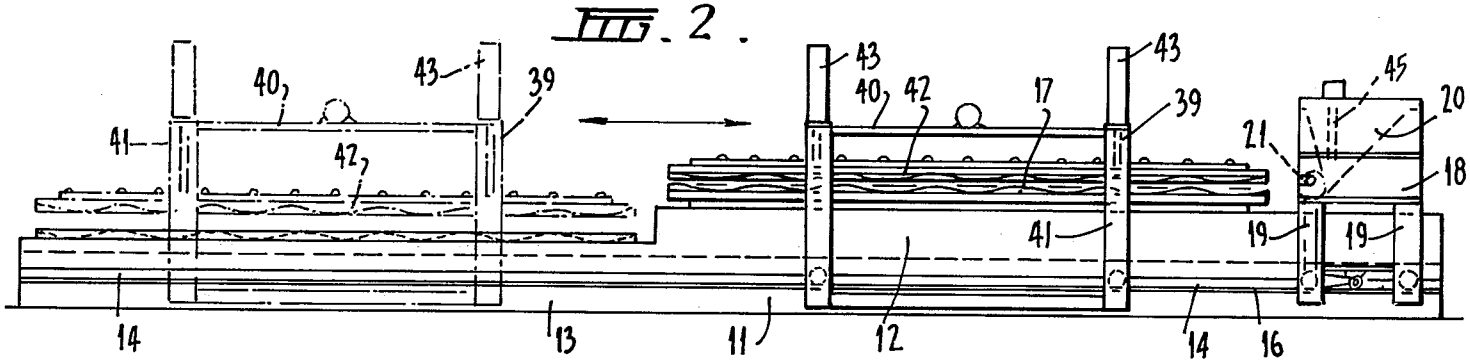
FIG. 2 is a view similar to FIG. 1 showing the apparatus at a different stage of operation.
Figure 3:
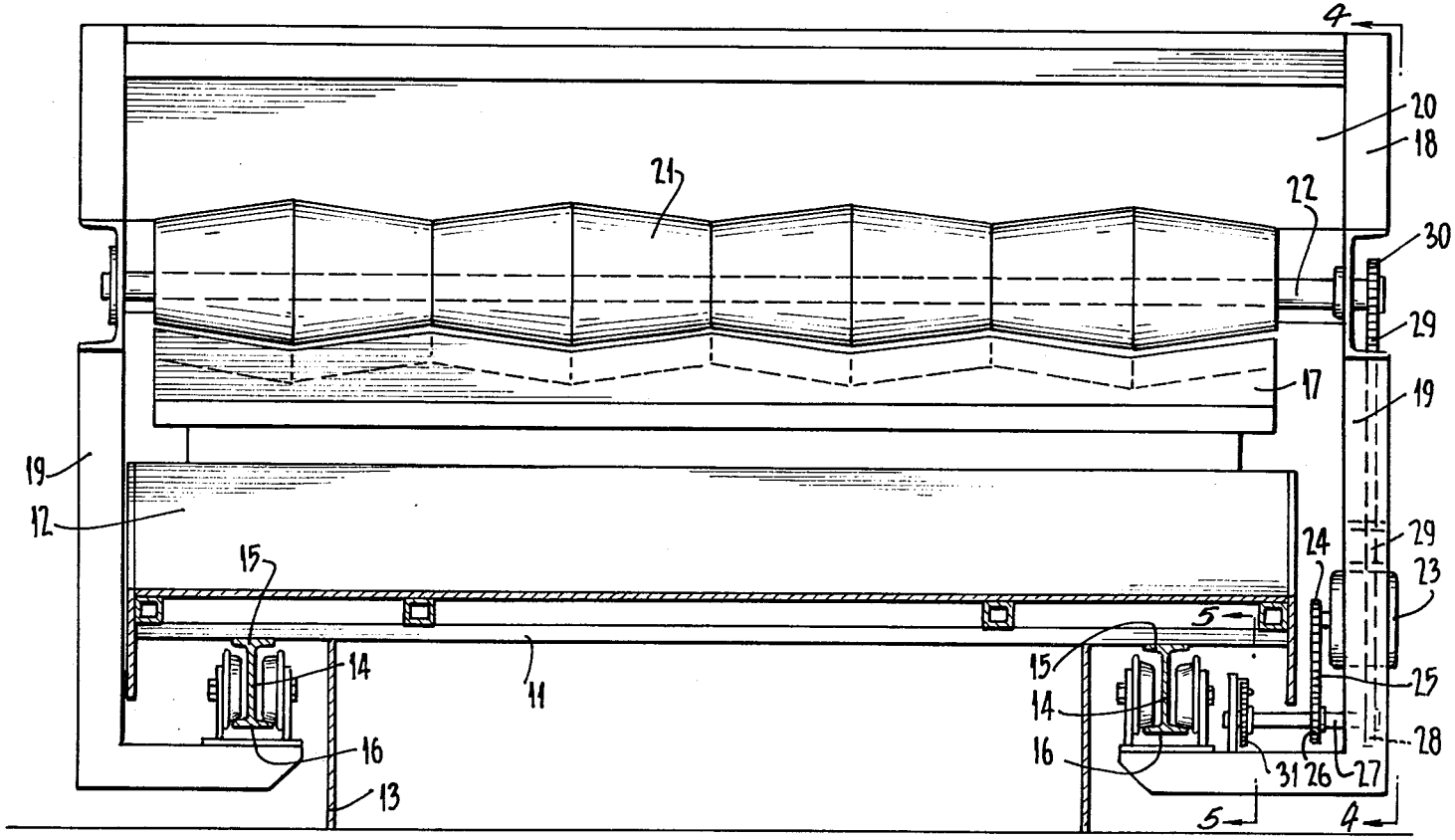
FIG. 3 is a view in section on line 3—3 of FIG. 1, on a larger scale.
Figure 7:
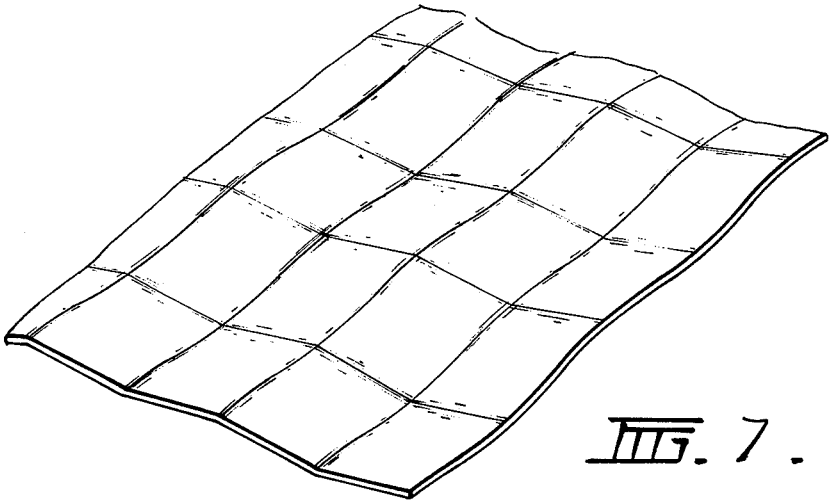
Figure 8:
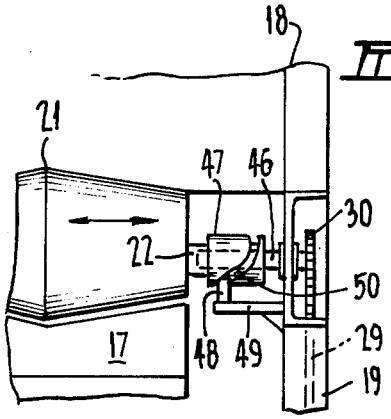
Figure 10:
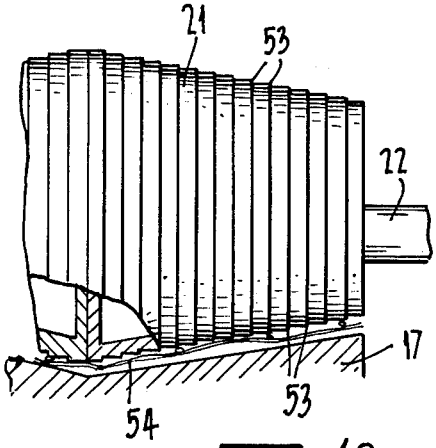
Figure 9:
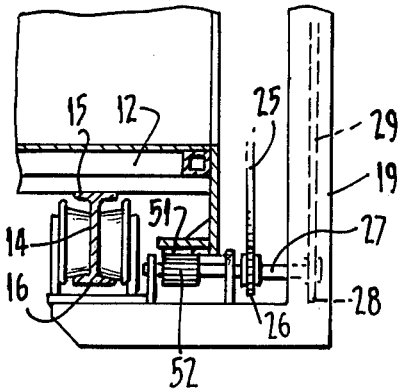

FIG. 7 is a perspective view showing part of a panel produced with the apparatus of FIGS. 1 to 6, FIG. 8 is a fragmentary view corresponding to part of FIG. 3 showing a manner of imparting additional movement to the profile forming device, FIG. 9 is another fragmentary view corresponding to another part of FIG. 3 showing a modified arrangement for driving the carriage of the profile forming device, and FIG. 10 is a fragmentary view showing part of a modified construction of the profile forming device. Apparatus according to this preferred form of the invention comprises a bed 11 which is rigidly supported on a floor or other foundation. An upper part 12 of the bed projects laterally at each side beyond a lower part 13 so as to provide longitudinally extending recesses one at each side of the lower part 13. The recesses provide housings for two horizontal rails 14 which extend parallel to each other in the longitudinal direction. The rails 14 each have an upper flange 15, whereby they are suspended from the projecting upper part 12 of the bed 11, and a lower flange 16. The upper surfaces of each flange 16, on each side of the rail web, provide running surfaces for trolleys carrying other parts of the apparatus which are hereinafter described.

As shown in FIG. 1 and 2 the upper part 12 of the bed 11 is stepped, somewhat more than half its length from the right hand end as seen in these Figures being higher than the remainder. The higher part of the bed, which is also regarded as the forward or front part of the apparatus supports a lower mould 17 of rigid formation, made of concrete or other suitable material. The upper surface of the mould 17 is shaped to suit the desired shape of panel to be produced in the apparatus which in the form shown is a shallow zig-zag in the transverse direction and sinuous in the longitudinal direction.

The apparatus includes a carriage 18 supported by trolleys 19 on the rails 14, and capable of moving from the rear of the lower mould 17 to beyond the front end thereof. The carriage 18 comprises a hopper 20 for containing a slurry of cementitious material, and a rotary profile forming device 21 in conjunction with the outlet of the hopper 20. The device 21 is mounted on a shaft 22 which extends transversely of the apparatus and is supported in bearings in the carriage 18. The device 21 has a cross-section which is circular but of varying diameter along its length. Thus from each end the diameter increases progressively for a distance, then reduces progressively at the same rate for an equal distance, and repeats this pattern a further three times. Hence the device 21 comprises eight frustoconical sections joined end to end and its longitudinal profile along any diametrical section is similar to the transverse profile of the lower mould 17. The shaft 22 is parallel to but displaced laterally from the geometrical diameter of the device 21, so that the latter is arranged eccentrically on the shaft, i.e. it has a non-constant radius whereby as the device 21 is rotated its lower surface moves away from and towards a fixed transverse surface below it, in a cyclic manner.

The carriage 18 has a motor 23 mounted on one trolley 19 and fitted with a sprocket wheel 24 which drives through a chain 25 to a sprocket wheel 26 fixed on a shaft 27 extending transversely to the apparatus below the overhanging edge of the upper bed 12 at that side. The outer end of the shaft 27 has fixed to it a sprocket wheel 28 driving a chain 29 which drives the shaft 22 through a sprocket wheel 30. The shaft 27 also has fixed to it another sprocket wheel 31 which engages the under side of a sprocket chain 32 which extends longitudinally below the upper bed 12 and is fixed at each end to brackets 33 and 34 on the rail 14. At the bracket 33 the chain is connected using a screw-threaded rod 35 and a nut 36 so that the tension of the chain can be adjusted. The chain 32 passes between two jockey sprockets 37 which are mounted on a bracket 38 on the trolley 19, and which keep the chain in mesh with the sprocket wheel 31. Thus when the motor 23 is driven in the anti-clockwise direction as viewed in FIGS. 1, 2, 4 and 5 the device 21 is turned in the anti-clockwise direction about the axis of the shaft 22 in the carriage 18, while the carriage is moved to the right by the engagement of the sprocket wheel 31 with the chain 32. The movements are synchronised so that from the position shown in FIG. 4 and FIG. 6 the path followed by the geometrical axis of the device 21 is a sinuous surface and the part of the periphery of the device 21 directly below the geometrical axis at any time traces out a surface which is at all points a constant distance above the surface of the lower mould 17.

The apparatus illustrated has a further carriage 39 comprising a horizontally extending frame 40 disposed at a height well above the lower mould 17 and supported by trolleys 41 running on the lower flanges of the rails 14. The carriage 39 can be moved between the position shown in full lines in FIG. 1 and chain lines in FIG. 2 to that in full lines in FIG. 2. It carries an upper mould 42 which can thus be moved between the position shown in FIG. 1 in which it is quite clear of the lower mould 17, and that shown in full lines in FIG. 2, in which it is directly above the mould 17.

The upper mould 42 is of rigid formation, being also made of concrete or other suitable material, and its lower surface is shaped complementary to the shape of the upper surface of the lower mould 17. The upper mould 42 is supported from the horizontal frame 40 of the carriage 39 by means of pneumatic cylinders 43 whereby it can be raised and lowered as required.

Although all details of the construction of the lower mould 17 and upper mould 42 are not shown in the drawings of this specification they are preferably constructed such that both moulds have provision for holding filter cloth against the mould surface and for withdrawing water from cementitious material between the moulds, by suction. Also both moulds have vibrators attached to them.

The hopper 20 is provided with control means such as a flap 44 for controlling the outflow of material and also with one or more vibrators 45 to facilitate the flow when the control means is open.

In using the apparatus so far described, a cycle of operations commences with the movable parts of the apparatus substantially in the positions shown in FIG. 1 i.e. with the carriage 18 and the carriage 39 both in their rearmost positions.

The cycle commences with the application of a low vacuum through the lower mould to draw the filter cloth firmly against its surface and remove any air bubbles or residual water.

In the next stage of the cycle a preformed wire mesh reinforcement is placed over the lower mould. This reinforcement is preformed to the same shape as the mould surfaces and in addition to this it is crimped or otherwise distorted at spaced points so that when it is placed on the mould it rests on the mould surface at these points with the remainder of it held above the mould surface by a vertical distance equal to half the width (in the vertical direction) of the desired panel.

The carriage 18 is then moved forwardly with the hopper control means open to spread slurry over the lower mould 17 and simultaneously the profile forming device 21 is rotated about the axis of the shaft 22 so that the device 21 rubs over the surface of the slurry and causes it to conform to the desired shape of the upper surface of the panel, with the reinforcement buried in the slurry.

The carriage 39 is also moved forwardly, following the carriage 18, and after the slurry has been poured and profiled with the device 21 the upper mould is moved downwardly into engagement with the slurry and thereafter vibration and suction are used to consolidate the material and to withdraw moisture from it. At the appropriate stage the upper mould 42 is raised with the formed panel held to it by suction and the carriage 39 is then moved rearwardly and the upper mould is lowered to deposit the formed panel on a table or other support having the appropriate configuration, or on a group of one or more previously formed panels resting on such a support.

FIG. 7 of the drawings gives an illustration of the configuration of the panel formed using the profile forming device 21 shown and described. As indicated the panel has a non-linear configuration in both the longitudinal direction and the transverse direction, which gives it desirable structural properties for some fencing, cladding and roofing purposes.

It is found in practice that the operation of the rotary device 21 leaves a layer of the slurry on the lower mould of which the upper surface is formed with considerable accuracy so that when the upper mould is applied to it there is little displacement of the material to accommodate completely to the upper mould surface.

FIG. 8 of the drawings illustrates how a further variation can be introduced into the configuration of the panel. In this arrangement the sprocket wheel 30 is fixed, not to the shaft 27 but to a short shaft 46 which is keyed into a sleeve 47 on the end of the shaft 27 whereby the two shafts are constrained to rotate together but the shaft 27 and device 21 are permitted a certain amount of movement in the axial direction. This movement is controlled by a pin 48 which is mounted on a bracket 49 fixed to the trolley 19 and engages in a sinuous cam slot 50 formed in the sleeve 47. Thus when the device 21 is moved in the longitudinal direction of the apparatus and is turned about the axis of the shaft 27, it also has a reciprocating movement in the direction of the axis. Hence with mould surfaces of appropriate shape the panel produced differs from that shown in FIG. 7 in that the ridges and valleys have themselves a sinuous configuration. Any suitable mechanism other than the pin and slot cam illustrated in FIG. 8 can be used to produce this additional motion of the device 21.

FIG. 9 of the drawings shows a modified arrangement for moving the carriage 18. In this arrangement there is no sprocket and chain corresponding to the sprocket 31 and chain 32 of the previous figures. Instead there is a rack 51 fixed to the side wall of the upper bed 12 and a pinion 52 fixed in the shaft 27 engages with the rack.

One way in which the device 21 can be constructed is by fastening together face to face a plurality of plates of different sizes. Thus, a device of circular cross-section can be formed from a quantity of circular plates and one of non-circular cross-section can be formed by fastening together a quantity of plates of other shapes. The plates may be fastened face to face by through-bolts or by keying them to a common shaft. A quantity of plates fastened together can be machined to produce a conical or other continuous surface. However, it may be advantageous to leave the edges of the plate square so that the article has a stepped profile. While the formation of the device from a quantity of plates fastened together has the merit of ease of manufacture and also facilitates the construction of an article with a stepped profile, it can result in the device being undesirably heavy. It is therefore worthwhile constructing the device from one or more hollow castings having a stepped external profile and FIG. 10 shows part of a profile forming device 21 which is formed of a number of hollow castings and which has a stepped profile. A particular advantage of the use of a stepped profile is achieved when forming panels with wire mesh reinforcement or with random strand reinforcement. Here the edges 53 of the steps of the device 21 engage and locate the reinforcement 54 as the device 21 moves over the material on the lower mould. Due to the triangular-section spaces between the edges 53, the passage of the device 21 over the material forms slight ridges of the slurry which thereafter spreads evenly and thereby the reinforcement is located in a controlled position in relation to the surface ultimately produced. The capacity of the material to spread in a localised situation, while controlling the tendency to slump over extensive areas may be used even more advantageously by making the lands of the steps not merely square but concave, or inclined in the reverse direction to the general profile of the surface of the member.

I claim:

1. Means for shaping the surface of moldable material comprising a rotatable device journalized for rotation about an axis, means operatively coupled to the device for advancing the device normal to its axis of rotation along and over material to be molded whereby the surface of the material is molded by the engagement of the lower part of the peripheral surface of the device with the material, and means coupled with the said device for rotating the device about its axis of rotation in a direction counter to the direction it would rotate if rolled along the material surface in the direction of advancement so that the lower peripheral surface of the device moves in the direction of advancement and relative to the rate of advancement of the device whereby the surface of the device in engagement with the material is continuously changed and there is relative movement between the surface of the device and the material, the radius from the axis of rotation of the device, in at least some cross-sections of the device, varying in a smooth and stepless manner around the periphery of the device, said device being of circular cross-section but arranged eccentrically so that its geometric axis is spaced from the axis of rotation.

2. Means according to claim 1 characterised in that the device has a cross-section which is not uniform but differs from place to place along the length of its axis of rotation.

3. Means according to claim 1 characterised in that the device is mounted so that it can move bodily relative to the material surface in directions other than said advancing direction, and in that means are provided operatively coupled to said device for moving the device bodily in said other directions in a cyclic fashion in synchronism with the rotation thereof.

4. Means according to claim 3 characterised in that the said means for moving the device bodily is constructed and arranged to move the device in the direction of its axis of rotation.

5. Means according to claim 2 characterised in that over at least part of the length of the device its cross-section is enlarged in stages whereby its periphery is formed as a plurality of steps.

* * * * *